US009044788B2

(12) United States Patent
Kudo et al.

(10) Patent No.: US 9,044,788 B2
(45) Date of Patent: Jun. 2, 2015

(54) BLOWING TARGET STRUCTURE, AND IMAGE FORMING APPARATUS

(71) Applicant: FUJI XEROX CO., LTD., Tokyo (JP)

(72) Inventors: Masafumi Kudo, Kanagawa (JP); Koji Otsuka, Kanagawa (JP); Yuki Nagamori, Kanagawa (JP); Kazuki Inami, Kanagawa (JP); Yasunori Momomura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 46 days.

(21) Appl. No.: 13/907,174

(22) Filed: May 31, 2013

(65) Prior Publication Data

US 2014/0140718 A1 May 22, 2014

(30) Foreign Application Priority Data

Nov. 16, 2012 (JP) ..... 2012-252041

(51) Int. Cl.

| | |
|---|---|
| ***G03G 21/20*** | (2006.01) |
| ***B08B 5/02*** | (2006.01) |
| ***G03G 15/02*** | (2006.01) |
| ***B08B 6/00*** | (2006.01) |

(52) U.S. Cl.

CPC ..... *B08B 5/02* (2013.01); *G03G 15/0291* (2013.01); *G03G 21/206* (2013.01); *B08B 6/00* (2013.01)

(58) Field of Classification Search

CPC ..... G03G 15/0291; G03G 21/206; G03G 15/095; G03G 21/10; G03G 2215/027

See application file for complete search history.

(56) References Cited

U.S. PATENT DOCUMENTS

| | | | | |
|---|---|---|---|---|
| 2007/0275048 | A1 * | 11/2007 | Liu et al. | 424/450 |
| 2008/0101816 | A1 * | 5/2008 | Nogami | 399/92 |
| 2008/0159776 | A1 * | 7/2008 | Tanase | 399/100 |

FOREIGN PATENT DOCUMENTS

| | | |
|---|---|---|
| JP | A-10-198128 | 7/1998 |

* cited by examiner

*Primary Examiner* — Roy Y Yi
(74) *Attorney, Agent, or Firm* — Oliff PLC

(57) ABSTRACT

A blowing target structure includes an opening portion that (a) is an inlet into which the air flow from a blower pipe that has an elongated shape in one direction, (b) is elongated in the same direction as the one direction of an outlet of the blower pipe, (c) has a member that is provided at least on one end side in a lateral direction orthogonal to a longitudinal direction of the opening portion to set an air permeability of a member side region of the opening portion to a value smaller than an air permeability of a region other than the member side region of the opening portion.

18 Claims, 19 Drawing Sheets

BLOWING TARGET STRUCTURE, AND IMAGE FORMING APPARATUS

CROSS-REFERENCE TO RELATED APPLICATIONS

This application is based on and claims priority under 35 USC 119 from Japanese Patent Application No. 2012-252041 filed Nov. 16, 2012.

BACKGROUND (i) Technical Field

The present invention relates to a blowing target structure, and an image forming apparatus.

(ii) Related Art

In image forming apparatuses that form an image constituted with a developer on a recording paper, for example, there is an image forming apparatus using a corona discharger that performs corona discharge in the process of charging a latent image holding member such as a photoconductor or the process of neutralization, the process of transferring a non-fixed image to the recording paper, or the like.

Additionally, in the corona discharger, in order to prevent unnecessary substances, such as paper debris or a discharge product, from adhering to component parts, such as a discharge wire or a grid electrode in advance, a blowing device that blows air against the component parts may be provided together. The blowing device in this case is generally constituted by a blower that sends air, and a duct (blower pipe) that guides and sends out the air sent from the blower up to a target structure, such as a corona discharger.

In the related art, improvements for enabling air to be uniformly blown in the longitudinal direction of the component parts, such as a discharge wire, are variously performed on the blowing device or the like. Particularly, as such a blowing device or the like, there is a blowing device that does not adopt a proposed configuration in which the shape of a passage space of a duct through which air is caused to flow, is formed in a special shape or a configuration, in which a straightening vane or the like that adjusts a direction in which air flows is installed in the passage space of the duct, but adopts a separate configuration as illustrated below.

SUMMARY

According to an aspect of the invention, there is provided a blowing target structure including: an opening portion that (a) is an inlet into which the air flow from a blower pipe that has an elongated shape in one direction, (b) is elongated in the same direction as the one direction of an outlet of the blower pipe, (c) has a member that is provided at least on one end side in a lateral direction orthogonal to a longitudinal direction of the opening portion to set an air permeability of a member side region of the opening portion to a value smaller than an air permeability of a region other than the member side region of the opening portion.

BRIEF DESCRIPTION OF THE DRAWINGS

Exemplary embodiments of the present invention will be described in detail based on the following figures, wherein:

FIG. 1 is an explanatory view showing the outline of a charging device and an image forming apparatus using the same related to Exemplary Embodiment 1 or the like;

FIG. 3A is a plan view showing a top face portion of the charging device, and FIG. 3B is a schematic cross-sectional view along line Q-Q of FIG. 3A;

FIG. 12A is a plan view showing a top face portion of the charging device, and FIG. 12B is a schematic cross-sectional view along line Q-Q of FIG. 12A;

FIG. 14A is a plan view showing a top face portion of the charging device, and FIG. 14B is a schematic cross-sectional view along line Q-Q of FIG. 14A;

FIG. 15A is an explanatory view showing an example of ventilation distribution in an opening portion, and FIG. 15B is an explanatory view showing a configuration example of the non-permeable member with respect to the ventilation distribution of FIG. 15A;

FIG. 16A is a plan view showing a top face portion of the charging device, and FIG. 16B is a schematic cross-sectional view along line Q-Q of FIG. 16A;

FIG. 17A is a plan view showing the permeable member, and FIG. 17B is a schematic cross-sectional view along line Q-Q of FIG. 17A;

FIG. 18A is an explanatory view showing an example of ventilation distribution in an opening portion, and FIG. 18B is an explanatory view showing a configuration example of the permeable member with respect to the ventilation distribution of FIG. 18A.

DETAILED DESCRIPTION

Hereinafter, the modes (hereinafter referred to as "exemplary embodiments") for carrying out the invention will be described in detail with reference to the accompanying drawings.

Exemplary Embodiment 1

Figure 1:
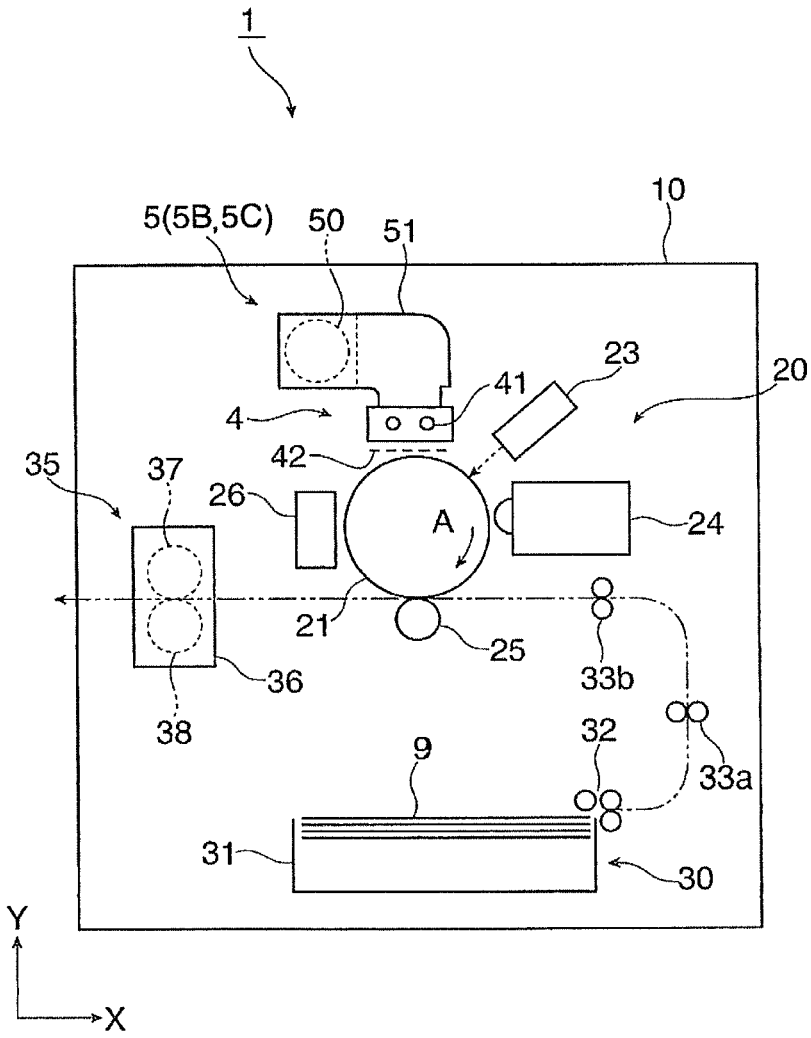
Figure 2:
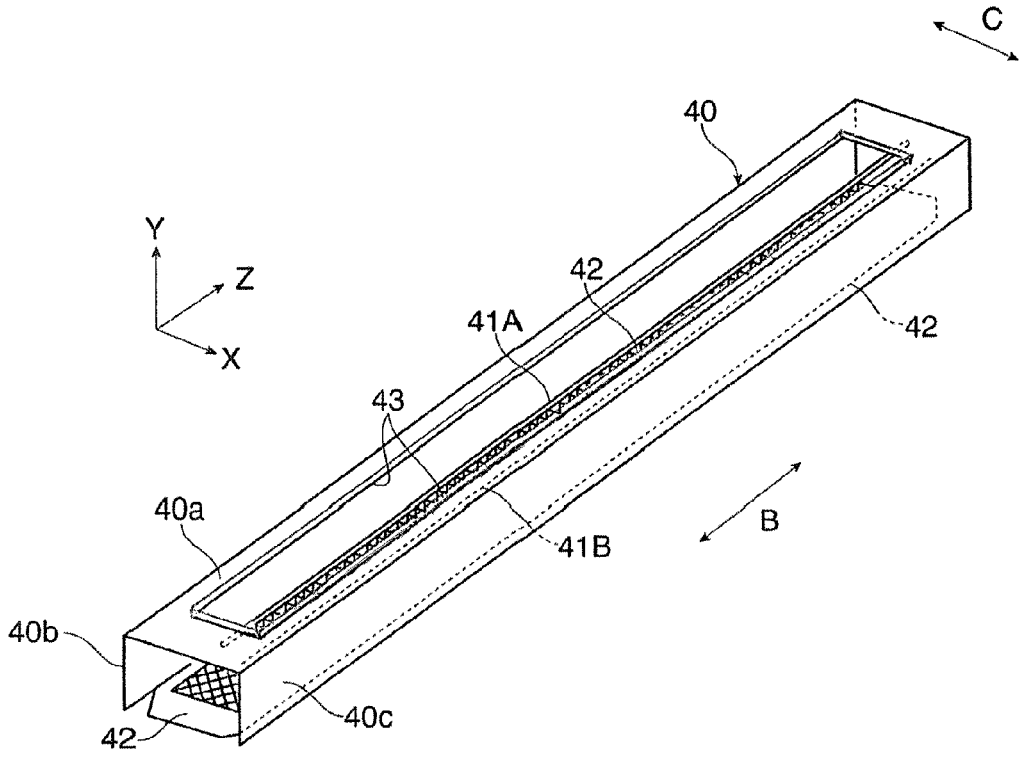
FIG. 2 is a schematic perspective view showing the charging device including a corona discharger of FIG. 1.
Figure 3A:
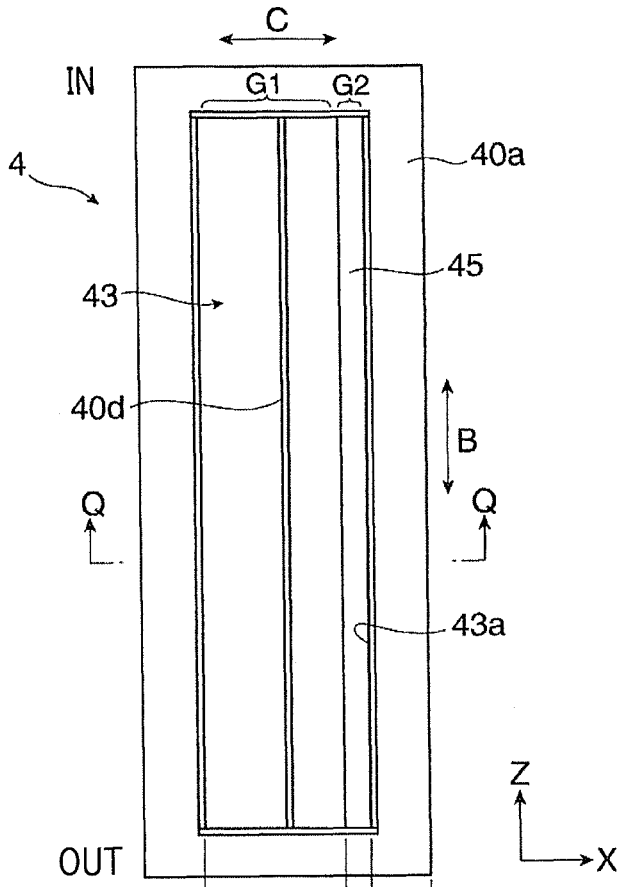
FIGS. 3A and 3B show a portion of the charging device of FIG. 2.
Figure 3B:
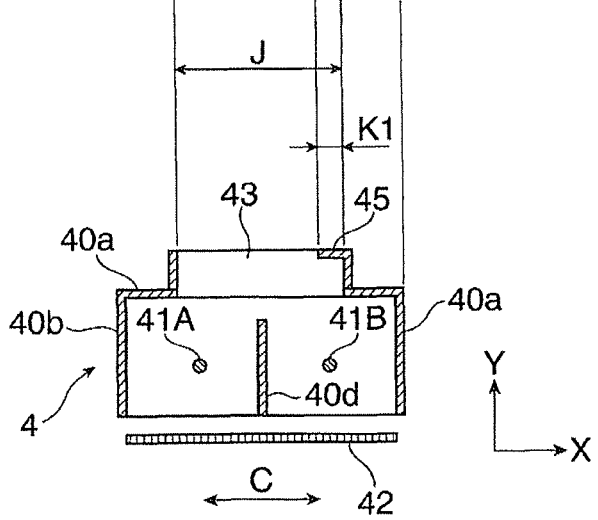

FIGS. 1 to 3B show an image forming apparatus using a charging device as an example of a blowing target structure related to Exemplary Embodiment 1. FIG. 1 shows the outline of the image forming apparatus, FIG. 2 shows the charging device in the image forming apparatus, and FIGS. 3A and 3B show a portion of the charging device.

Configuration (Including Charging Device) of Image Forming Apparatus

In the image forming apparatus 1, as shown in FIG. 1, an image forming unit 20 that forms a toner image constituted by toner as a developer to transfer the toner image to a sheet 9 as an example of a recording material, a sheet feeder 30 that accommodates and transports sheets 9 to be supplied to the image forming unit 20, and a fixing device 35 that fixes the toner image formed by the image forming unit 20 on a sheet 9 are installed in an internal space of a housing 10 constituted by a support frame, a sheathing cover, or the like. Although only one image forming unit 20 is illustrated in Exemplary Embodiment 1, the image forming unit may be constituted by plural image forming units.

The above image forming unit 20 is configured, for example, utilizing a well-known electrophotographic system, and is mainly constituted by a photoconductor drum 21 that is rotationally driven in the direction (the clockwise direction in the drawing) indicated by an arrow A, a charging device 4 that charges a peripheral surface that is an image formation region of the photoconductor drum 21 with a required potential, an exposure device 23 that forms an electrostatic latent image with a potential difference that irradiates the surface of the photoconductor drum 21 after charging with light (dotted line with an arrow) based on image information (signal) input from the outside, a developing device 24 that develops the electrostatic latent image as a toner image with a toner, a transfer device 25 that transfers the toner image to a sheet 9, and a cleaning device 26 that removes the toner or the like that remains on the surface of the photoconductor drum 21 after transfer.

Among these, a corona discharger is used as the charging device 4. The charging device 4 including the corona discharger, as shown in FIG. 2 or the like, is constituted by a so-called scorotron type corona discharger including a shielding case 40 as an example of a surrounding member with an external shape having an oblong top plate 40*a*, and lateral plates 40*b* and 40*c* that hang downward from a long side portion extending along the longitudinal direction B of the top plate 40*a*, two end supports (not shown) that are respectively attached to both ends (short side portions) of the shielding case 40 in the longitudinal direction B, two corona discharge wires 41A and 41B that are attached in a state where the wires pass through the internal space of the shielding case 40 and are stretched almost in the shape of a straight line between these two end supports, and a grid-like grid electrode (electric field adjustment plate) 42 that is attached to a lower opening (discharge opening) of the shielding case 40 in a state where the plate covers the lower opening and is present between the corona discharge wires 41 and the peripheral surface of the photoconductor drum 21. Reference numeral 40*d* shown in FIG. 4 or the like represents a partition wall that partitions the space where the two corona discharge wires 41A and 41B along the longitudinal direction B of the shielding case 40 are arranged.

Additionally, the charging device 4 is arranged such that the two corona discharge wires 41A and 41B are present at least in an image forming target region along the direction of a rotational axis of the photoconductor drum 21 in a state where the wires face each other at a required interval (for example, discharge gap) from the peripheral surface of the photoconductor drum 21. Additionally, the charging device 4 is adapted such that charging voltages are respectively applied to the discharge wires 41A and 41B (between the wires and the photoconductor drum 21) from a power unit (not shown) when an image is formed.

The sheet feeder 30 includes a sheet accommodation member 31 of a tray type, a cassette type, or the like that accommodates plural sheets 9 including a required size, required kind, or the like to be used for formation of an image, in a stacked state, and a delivery device 32 that delivers the sheets 9 accommodated in the sheet accommodation member 31 one by one toward a transporting path. If the timing for sheet feeding comes, the sheets 9 are delivered one by one. Plural sheet accommodation members 31 are provided according to utilization modes. A one-dot chain line with an arrow in FIG. 1 shows a transporting path in which a sheet 9 is mainly transported along and passes through. This transporting path for sheets is constituted by plural sheet transporting roll pairs 33*a* and 33*b*, transporting guide members (not shown), or the like.

The fixing device 35 includes, inside a housing 36 formed with an introduction port and a discharge port through which a sheet 9 passes, a roller-shaped or belt-shaped heating rotary member 37 of which the surface temperature is heated to and maintained at a required temperature by a heating unit, and a roller-shaped or belt-shaped pressurizing rotary member 38 that is rotationally driven in contact with the heating rotary member at a required pressure so as to extend substantially along the direction of the rotational axis of the heating rotary member 37. The fixing device 35 performs fixing by allowing a sheet 9 after a toner image is transferred to be introduced into and pass through a contact portion (fixing treatment section) that is formed as the heating rotary member 37 and the pressurizing rotary member 38 come into contact with each other.

Image formation by the image forming apparatus 1 is performed as follows. Here, a basic image forming operation when an image is formed on one side of a sheet 9 will be described as an example.

In the image forming apparatus 1, if the control device or the like receives a start command for an image forming operation, in the image forming unit 20, the peripheral surface of the photoconductor drum 21 that starts to rotate is charged with predetermined polarity and potential by the charging device 4. At this time, in the charging device 4, corona discharge is generated in a state where charging voltages are applied to the two corona discharge wires 41A and 41B, respectively, and an electric field is formed between each of the discharge wires 41A and 41B and the peripheral surface of the photoconductor drum 21, and thereby, the peripheral surface of the photoconductor drum 21 is charged with a required potential. In this case, the charging potential of the photoconductor drum 21 is adjusted by the grid electrode 42.

Subsequently, an electrostatic latent image, which is configured with a required potential difference as exposure is performed on the basis of image information from the exposure device 23, is formed on the peripheral surface of the charged photoconductor drum 21. Thereafter, when the electrostatic latent image formed on the photoconductor drum 21 passes through the developing device 24, the electrostatic latent image is developed with toner that is supplied from the developing roll 24*a* and charged with a required polarity, and is visualized as a toner image.

Next, if the toner image formed on the photoconductor drum 21 is transported to a transfer position that faces the transfer device 25 by the rotation of the photoconductor drum 21, the toner image is transferred by the transfer device 25 to a sheet 9 to be supplied through a transporting path from the sheet feeder 30 according to this timing. The peripheral surface of each photoconductor drum 21 after this transfer is cleaned by the cleaning device 26.

Subsequently, the sheet 9 to which the toner image is transferred in the image forming unit 2 is transported so as to be introduced into the fixing device 35 after being peeled off from the photoconductor drum 21, is heated under pressurization when passing through the contact portion between the heating rotary member 37 and the pressurizing rotary member 38 in the fixing device 35 so as to be melted, and is fixed on the sheet 9. The sheet 9 after this fixing is completed is ejected from the fixing device 35, and is transported and accommodated in an ejected sheet accommodation section (not shown) or the like, that is formed, for example, outside the housing 10.

A monochrome image constituted by a single-color toner is formed on one side of one sheet 9, and the basic image forming operation is completed. When there is an instruction for the image forming operation for plural sheets, a series of operations as described above are similarly repeated by the number of sheets.

Configuration of Blowing Device

Additionally, in the image forming apparatus 1, with the use of the charging device 4, substances (unnecessary substances), such as debris of the sheet 9, a discharge product generated by corona discharge, and external additives adhere to the corona discharge wires 41 or the grid electrode 42, and are contaminated, and the corona discharge is no longer sufficiently or uniformly performed. As a result, charging defects, such as uneven charging, may occur.

For this reason, in the image forming apparatus 1, as shown in FIG. 1, 4, or the like, in order to prevent or keep unnecessary substances from adhering to the discharge wires 41 and the grid electrode 42, a blowing device 5 for blasting air against the internal space (the discharge wires 41 and the grid electrode 42) of the shielding case 40 is provided together at the charging device 4. Additionally, as shown in FIG. 2, FIGS. 3A and 3B, or the like, the top face 40*a* of the shielding case 40 of the charging device 4 is formed with an opening 43 for taking in the air from the blowing device 5.

Figure 4:
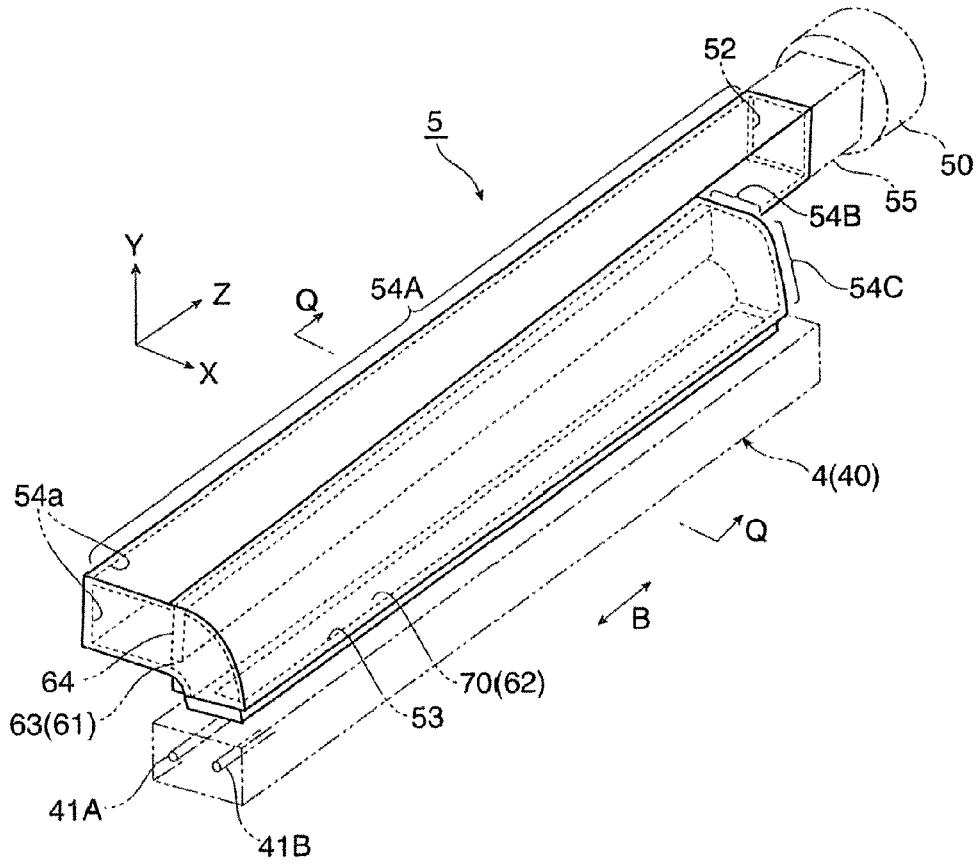
FIG. 4 is a schematic perspective view showing the outline of a blowing device (blower duct) to be applied to the charging device of FIG. 2.

As shown in FIG. 4 or the like, the blowing device 5 includes a blower 50 that has a rotary fan that sends air, and a blower duct 51 that takes in the air sent from the blower 50 and guides and discharges the air up to the charging device 4 that is an object to be blown.

As the blower 50, for example, an axial flow type blower fan is used and the driving thereof is controlled so as to send a required volume of air. Additionally, as shown in FIGS. 4 to 7, the blower duct 51 is formed in a shape having an inlet 52 that takes in the air sent from the blower 50, an outlet 53 that is arranged in a state where the outlet faces the portion (the top face 40*a* of the shielding case 40 or its opening 43), in the longitudinal direction B, of the elongated charging device 4 against which the air taken in from the inlet 52 is blown, and sends the air so as to flow along a direction orthogonal to the longitudinal direction B, and a passage portion 54 formed with a passage space TS for connecting between the inlet 52 and outlet 53 to cause air to flow therethrough.

The passage portion 54 of the blower duct 51 has one end portion provided with the inlet 52 and opened and has the other end portion closed, and the overall passage portion is constituted by an angular-tube-shaped introduction passage portion 54A formed so as to extend along the longitudinal direction B of the charging device 4, an angular-tube-shaped first bent passage portion 54B formed so as to extend after being almost at a right angle to a substantially horizontal direction (direction substantially parallel to the coordinate axis X) in a state where the width of the passage space is increased from a part near the other end portion of the introduction passage portion 54A, and a second bent passage portions 54C formed so as to extend after being finally bent in a downwardly perpendicular direction (direction substantially parallel to the coordinate axis Y) so as to approach the charging device 4 in a state where the width of the passage space remains equal from one end portion of the first bent passage portion 54B. A termination end of the second bent passage portion 54C is formed with an outlet 53 including an opening shape that is slightly narrower than the cross-sectional shape of the passage space of the termination end (however, the longitudinal length of the oblong shape is almost the same). The widths (dimensions along the longitudinal direction B) of both the passage spaces TS of the first bent passage portion 54B and the second bent passage portion 54C are set to almost the same dimension.

Figure 6:
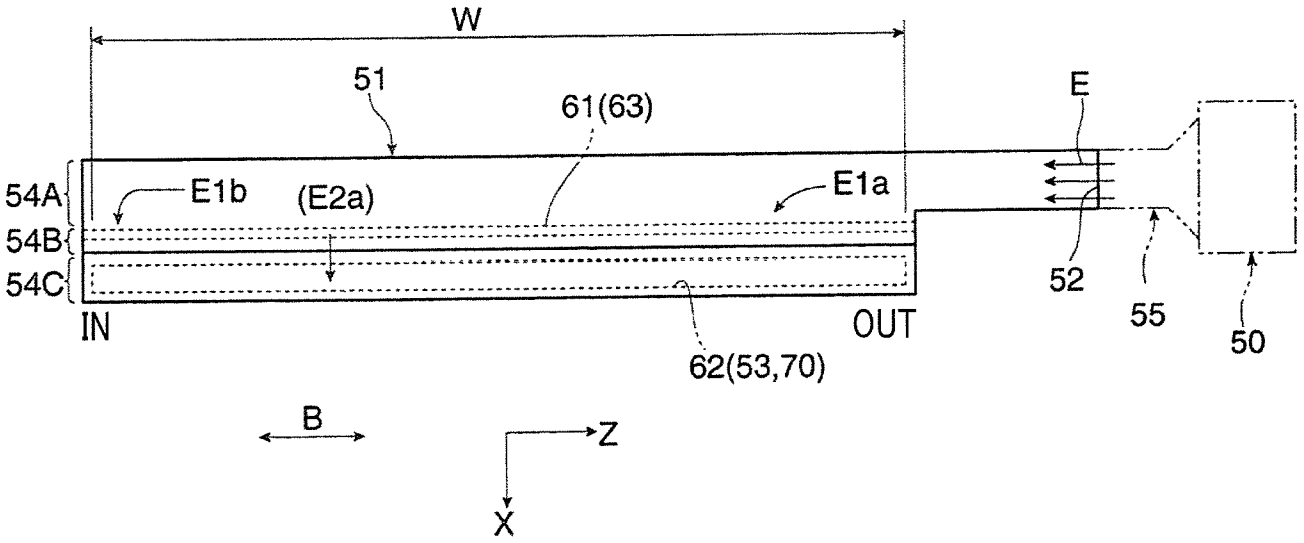
FIG. 6 is a schematic view showing a state when the blowing device of FIG. 4 is seen from above.
Figure 7:
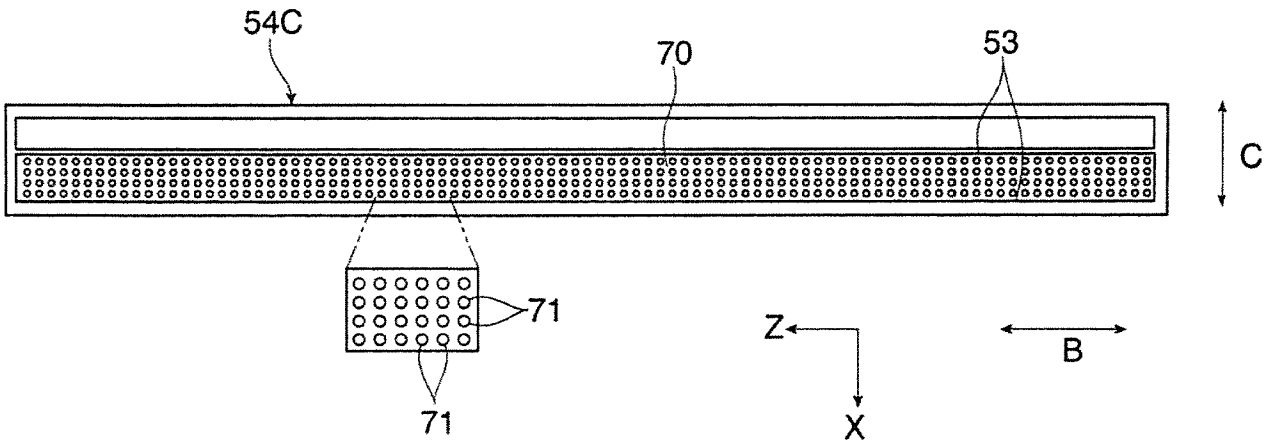
FIG. 7 is a view showing a state when the blowing device of FIG. 4 is seen from below (outlet)

The inlet 52 of the blower duct 51 is formed so that the opening shape thereof becomes substantially square. A connection duct 55 for connecting between the blower duct and the blower 50 to send the air from the blower 50 up to the inlet 52 of the blower duct 51 is attached to the inlet 52 (FIG. 6). Additionally, the outlet 53 of the blower duct 51 is formed so that the opening shape thereof becomes an elongated shape (for example, oblong shape) parallel to the portion of the charging device 4 in the longitudinal direction B. For this reason, the blower duct 51 has the relationship where the inlet 52 and the outlet 53 are formed in mutually different opening shapes. In addition, even in a case where the inlet 52 and the outlet 53 have the same shape, when the inlet and the outlet are formed so as to have mutually different opening areas (when the inlet and outlet have a similar shape) is included in the relationship where the inlet and the outlet are formed in mutually different opening shapes. Additionally, the opening shape of the opening portion 43 of the shielding case 40 in the charging device 4 is formed in an oblong shape that is elongated shape in the same direction as the longitudinal direction of the outlet 53 so as to substantially correspond to the shape of the outlet 53 of the blower duct 51.

Here, in the blower duct 51 in which the inlet 52 and the outlet 53 are formed in mutually different opening shapes in this way, the portion in which the cross-sectional shape of the passage space TS is changed on the way is present in the passage portion 54 that connects between the inlet 52 and outlet 53. Incidentally, in the blower duct 51, the cross-sectional shape of the passage space TS1 including a substantially square shape, of the introduction passage portion 54A is changed to the cross-sectional shape of the passage space TS2 including an oblong shape that widens only in the horizontal direction (irrespective of height) in the first bent passage portion 54B. In other words, the cross-sectional shape of the passage space TS1 of the introduction passage portion 54A is changed to the cross-sectional shape of the passage space TS2 that abruptly becomes wide in the first bent passage portion 54B.

Additionally, in the case of the blower duct 51 in which such a portion in which the cross-sectional shape of the passage space TS changes is present, a disturbance, such as flaking or vortex, occurs in the flow of air in the portion in which the cross-sectional shape of the blower duct changes. For this reason, even if air with a uniform wind speed is taken in from the inlet 52, the wind speed of the air that comes out from the outlet 53 tends to become non-uniform. However, the tendency that the wind speed of the air that comes out from the outlet in this way occurs almost similarly even in a case where the direction in which the air in the blower duct 51 is caused to flow (proceed) changes irrespective of the presence of a change in the cross-sectional shape of the passage space TS.

Figure 19A:
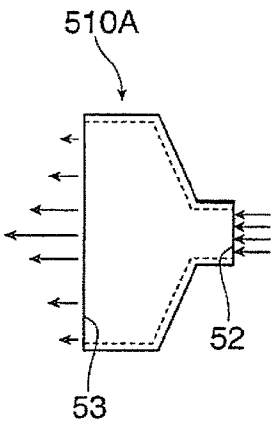
FIGS. 19A to 19D are schematic explanatory views showing another configuration example of the blower duct.
Figure 19B:
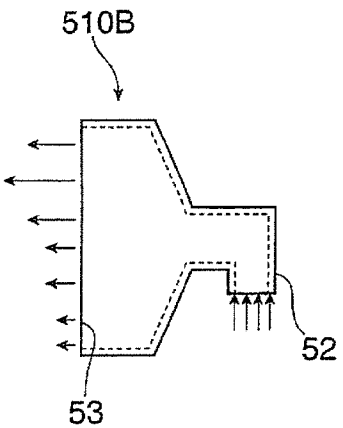
Figure 19C:
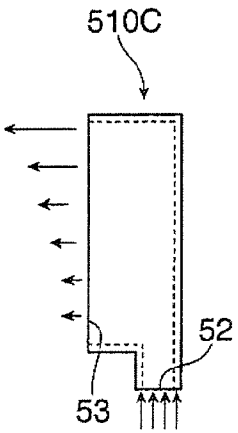
Figure 19D:
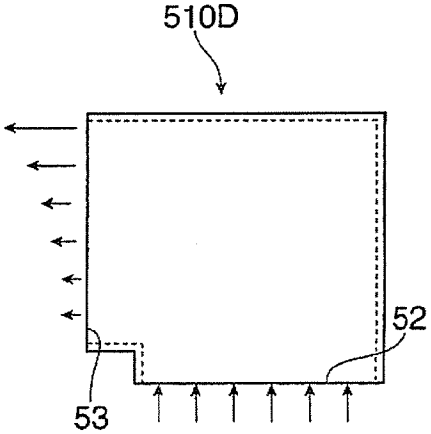

FIGS. 19A to 19C show representative examples 510A to 510C of the blower duct in which the inlet 52 and the outlet 53 are formed in mutually different opening shapes. In the drawings, respective states of the wind speed of air taken into the inlet 52 and the wind speed of air that comes out from the outlet 53 in the respective ducts 510 are shown by the lengths of arrows, respectively. FIGS. 19A to 19D show the respective blower ducts 510 seen from the top face thereof. Additionally, in the drawings, cases where the lengths of the arrows are the same show that the wind speeds are the same, and cases where the lengths of the arrows are different show that the wind speeds are different. Moreover, dotted lines in the drawings show (side wall portions that form) the passage spaces of the respective ducts. Incidentally, the blower ducts 510B and 510C are also configuration examples in which the direction in which air is caused to flow is changed on the way, and at least one of the cross-sectional shape and cross-sectional area of a passage space is changed. In addition, the blower duct 510D shown in FIG. 19D is a configuration example in which the inlet 52 and the outlet 53 are formed in the same opening shape (and the same opening area), and is a duct in which only the direction in which air is caused to flow is changed on the way.

In line with such a situation, as the blower duct 51 of the blowing device 5, as shown in FIGS. 4 to 7 or the like, two suppressing portions 61 and 62 that suppress the flow of air are provided in different regions in the direction (the direction of the arrow represented by the symbol E) that the air of the passage space TS of the passage portion 54 is caused to flow. The suppressing portion 62 of the two suppressing portions is an outlet suppressing portion (most downstream suppressing portion) provided at the outlet 53 that becomes a terminal of the passage portion 54, and the other suppressing portion 61 is an upstream suppressing portion provided in a region located on the most upstream side in the direction in which air is caused to flow than the outlet suppressing portion 62 in the passage space TS of the passage portion 54.

The upstream suppressing portion 61 is provided at a substantially intermediate position in the direction in which air is caused to flow in the passage space TS2 of the first bent passage portion 54B. The upstream suppressing portion 61 is configured in such a manner to cut off a portion of the passage space TS2 in a state where the upstream suppressing portion runs along the direction parallel to the longitudinal direction (the same direction as the longitudinal direction B of the charging device 4) of the opening shape of the outlet 53, and so as to have a gap 63 in a shape that extends in the longitudinal direction of the opening shape of the outlet 53.

The upstream suppressing portion 61 in Exemplary Embodiment 1 is configured by causing a plate-shaped partition member 64 to be present within the passage space TS2 of the bent passage portion 54B without changing the external shape of the first bent passage portion 54B. Specifically, the partition member 64 closes an upper space portion in the passage space TS2 of the first bent passage portion 54B, and is arranged so that a lower end 64*a* of the partition member has a required interval (height) H with respect to the bottom (inner wall) 55 of the passage space TS2. This forms a structure where the gap 63 is present in a lower portion of the passage space TS2. The partition member 64 is formed by being molded integrally with the same material as the duct 51 or is formed from a material separate from the duct 51.

The height H, path length M, and width (longitudinal length) W of the gap 63 are selected and set from the viewpoint of making the wind speed of air that has flowed into the first bent passage portion 54B from the introduction passage portion 54A as uniform as possible, and are set in consideration of the dimensions (capacity) of the duct 51, and the flow rate per unit time of air caused to flow to the duct 51, the charging device 4, or the like. For example, the height H of the gap 63 can be set to the dimension uniformly or partially changed from the above viewpoint or the like without being limited to a case where the dimension is the same in the longitudinal direction of the width W.

Figure 5:
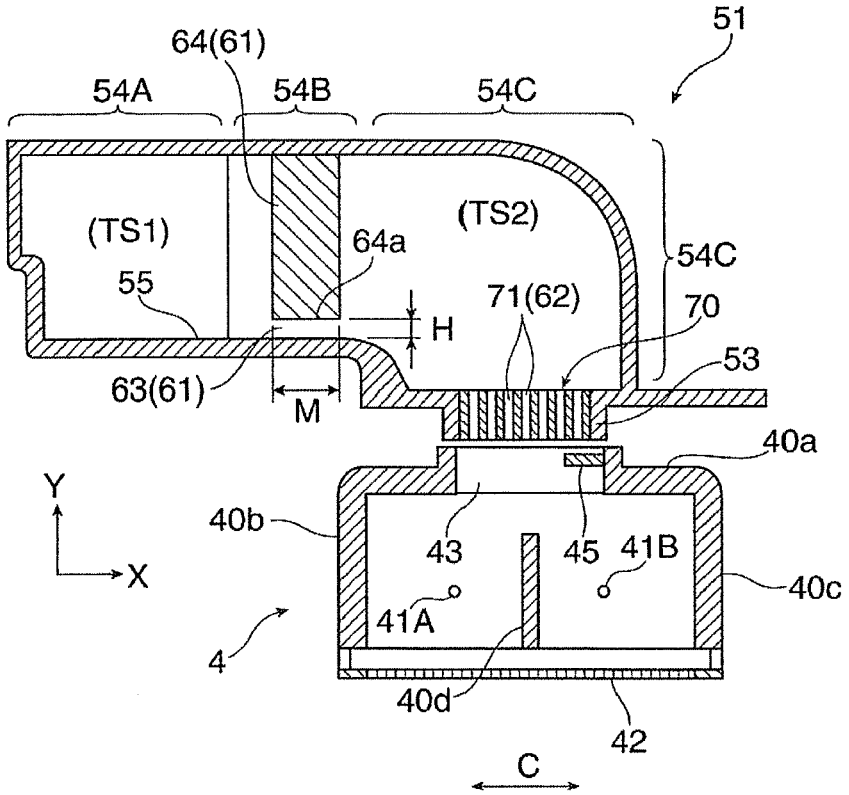
FIG. 5 is a cross-sectional view along line Q-Q of the blowing device (blower duct) of FIG. 4.

On the other hand, the outlet suppressing portion 62 in Exemplary Embodiment 1, as shown in FIG. 5, 7, or the like, is formed by bringing about a state where the passage space (opening) in the termination end (outlet 53) of the second bent passage portion 54C is closed by a permeable member 70 having plural ventilation portions 71.

As shown in FIG. 5, 7, or the like, all the plural ventilation portions 71 in the permeable member 70 are through holes that extend so that each opening shape is substantially circular and that penetrate in the shape of a straight line. Additionally, the plural ventilation portions 71, for example, are arranged at regular intervals along the longitudinal direction (B) of the opening shape of the outlet 53, and are arranged so as to be present, for example, in four rows at the same intervals as the above regular intervals even in the lateral direction C orthogonal to the longitudinal direction. Thereby, the plural air holes 71 are formed so as to be dotted throughout the passage space of the terminating end of the second bent passage portion 54C, or the opening shape of the outlet 53. For this reason, the permeable member 70 in Exemplary Embodiment 1 is a perforated plate formed so that the plural ventilation portions (holes) 71 are dotted in a plate-shaped member. Moreover, it is preferable that the plural ventilation portions 71 be formed so as to be dotted substantially uniformly (in a substantially constant density) in the opening region of the outlet 53. However, unless the air that comes out from the outlet 53 comes out non-uniformly, the ventilation portions may be formed so as to be present in a slightly dense state.

The permeable member 70 may be formed by being molded integrally with the same material as the duct 51 or may be formed from a material separate from the duct 51. The opening shape, opening dimensions, hole length, and hole presence density of the ventilation portions (holes) 71 are selected and set from the viewpoint of making the wind speed of air that has flowed out of the second bent passage portion 54C through the outlet 53 as uniform as possible. Additionally, these values are set in consideration of the dimensions (capacity) of the duct 51, the flow rate per unit time of air that is caused to flow to the duct 51, the charging device 4, or the like.

The blowing device 5 operates as follows.

If the blowing device 5 arrives at driving setting timing, such as image forming operation timing, the blower 50 is first rotationally driven to send out a required volume of air. The air (E) sent from the started blower 50 is taken into the passage space TS of the passage portion 54 through the connection duct 55 from the inlet 52 of the blower duct 51.

Subsequently, as shown in FIG. 6 or the like, the air (E) taken into the blower duct 51 is sent so as to flow into the passage space TS2 of the first bent passage portion 54B through the passage space TS1 of the introduction passage portion 54A (refer to arrows E1*a*, E1*b*, or the like of FIG. 6). The air (E1) sent into the first bent passage portion 54B passes through the gap 63 of the upstream suppressing portion 61, and proceeds in a state where the proceeding direction (direction in which air flows) thereof is changed to an almost right-angled direction.

Figure 8:
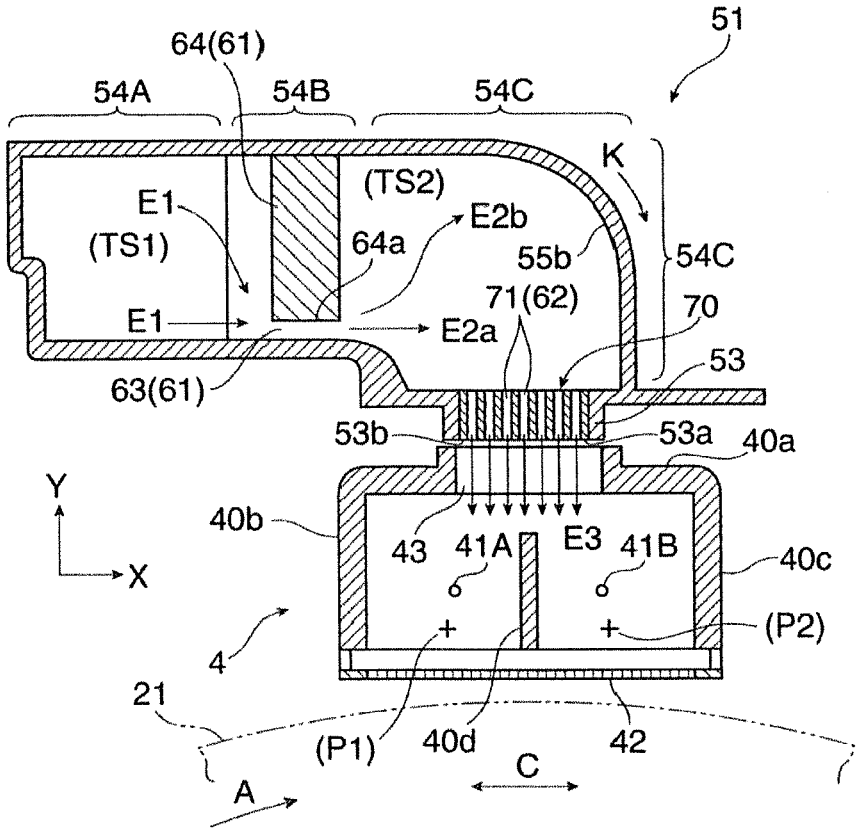
FIG. 8 is a cross-sectional explanatory view showing the operating state or the like of the charging device (contents in which illustration of a portion of the configuration is omitted) and the blowing device of FIG. 4.

In this case, the air (E2) when passing through the gap 63 of the upstream suppressing portion 61, as shown in FIG. 8 or the like, has its flow suppressed by the gap 63 of the upstream suppressing portion 61 (the pressure of the air is brought into a raised state), and tends to flow out of the gap 63 in a uniform state. Moreover, as for the air (E2) when flowing into the passage space TS2 of the first bent passage portion 54B after passing through the gap 63 of the suppressing portion 61, the direction of the air when flowing out of the gap 63 is aligned with a direction substantially orthogonal to the longitudinal direction (B) of the outlet 53. In addition, in FIG. 8, illustration of a non-permeable member (45) to be described below is omitted for convenience.

Subsequently, the air (E2) that has flowed into the passage space TS2 of the second bent passage portion 54C flows into the passage space TS2 of the second bent passage portion 54C whose volume is larger than the passage space TS of the introduction passage portion 54A or the space of the gap 63, and is thereby swirled and stagnated within the passage space TS2 of the second bent passage portion 54C, and the unevenness of the wind speed is reduced.

At this time, a portion E2*a* of the air (E2) that has passed through the gap 63 of the upstream suppressing portion 61 and has flowed into the passage space 54*c* proceeds substantially linearly along the path of the gap 63. Additionally, the other air E2*b* proceeds in such a curved manner that the air is diffused within the passage space TS of the second bent passage portion 54C. Particularly in a case where the volume of air introduced from the inlet 52 of the blower duct 51 is relatively large, the flow of the air E2*a* that proceeds linearly from the gap 63 becomes stronger than that of the other air E2*b*.

Finally, the air (E2) that has flowed into and stagnated in the passage space TS2 of the second bent passage portion 54C, as shown in FIG. 8, passes through the plural ventilation portions (holes) 71 in the permeable member 70 that constitutes the outlet suppressing portion 62 provided at the outlet 53 that is a termination end of the bent passage portion 54C, and is thereby blown out from the outlet 53 in a state where the proceeding direction thereof is changed (refer to the arrow E3).

In this case, the air (E3) blown out from the outlet 53 passes through the plural ventilation portions 71 of the permeable member 70 that is relatively narrower than the opening area of the outlet 53, and is thereby sent out in a state where the flow thereof is suppressed (at this time, the pressure of the air is brought into a raised state).

The air (E3) that passes through the outlet suppressing portion 62 and is blown out from the outlet 53 passes through the plural ventilation portions 71 that are substantially uniformly dotted in the region of the outlet 53 and that are formed on the same conditions, and is thereby sent out from the outlet 53 in a uniform state. Additionally, the air (E3) blown out from the outlet 53 has its proceeding direction changed to the direction substantially orthogonal to the longitudinal direction B of the outlet 53 and the direction that faces the charging device 4, and is sent out.

From the above, all air (E3) that passes the outlet suppressing portion 62 and comes out from the outlet 53 is sent out in a state where the proceeding direction thereof becomes the direction substantially orthogonal to the longitudinal direction of the outlet 53, and the wind speed thereof is brought into a substantially uniform state. Additionally, the wind speed of the air (E3) that comes out from the outlet 53 is brought into a substantially uniform state in the longitudinal direction (B) of the opening shape (oblong shape) of the outlet 53, and is brought into a substantially uniform state also in the lateral direction C.

Then, the air (E3) sent out from the outlet 53 of the blower duct 51 in this blowing device 5, as shown in FIG. 8, flows in so as to be blown into the case 40 through the opening portion 43 in the top face 40*a* of the shielding case 40 of the charging device 4.

Detailed Configuration of Charging Device

Figure 9:
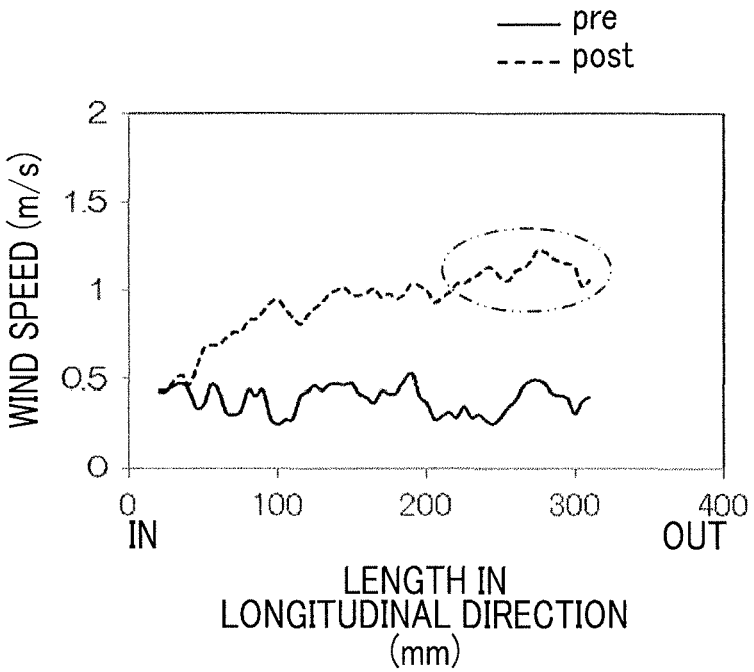
FIG. 9 is a graph chart showing the results when the ventilation distribution in the charging device of FIG. 8 is measured.

Incidentally, as for the distribution of the wind speed of the air discharged from the blower duct 51 of the blowing device 5, as illustrated in FIG. 9, the wind speed of the air discharged from an end region that is present at least on one end side (for example, an end portion 53*a* located on post-side to be described below: FIG. 8) in the lateral direction C orthogonal to the longitudinal direction B in a region along the longitudinal direction B of the outlet 53 of the blower duct 51 becomes relatively faster than the wind speed of the air discharged from regions other than the end region of the outlet. As a result, the distribution of the wind speed may be brought into a non-uniform state.

The phenomenon in which the wind speed of the air (E3) discharged from the outlet 53 of the blower duct 51 is relatively different between an end region on one end side of the outlet 53 and the other end region in this way is influenced by the presence of the suppressing portion 61 of the blower duct 51, the presence of the second bent passage portion 54C, or the like. For example, as illustrated in FIG. 8, it is one factor that the air (E2*a*) that proceeds linearly and flows into the passage space TS2 of the second bent passage portion 54C as mentioned above is generated, the air (E2*a*) collides with an inner wall portion 55*b* that is present on the outer side in a bent direction K of the bent passage portion 54C, and then, a portion of the air flow out as it is toward one end 53*a* of the outlet 53 near a termination end of the inner wall portion 55*b*, without stagnating in the passage space TS2. Additionally, it is also one factor that the amount of the air introduced into the blower duct 51 increases relatively.

Incidentally, the measurement results of the wind speed distribution illustrated in FIG. 9 are obtained by performing the following measurement.

That is, the measurement at this time is performed introducing air with an average air volume of 0.25 $m^3$/min from the blower 50, and then, measuring the wind speed (wind speed in the whole region of the outlet in the longitudinal direction B) of the air when being blown out from the outlet 53 of the blower duct 51 and being taken inside the case 40 through the opening portion 43 of the shielding case 40 of the charging device 4. The wind speed is measured using an air speedometer (UAS1200LP made by DEGREE CONTROLS, INC). Specifically, as shown in FIG. 8, the measurement is performed by moving the air speedometer in the longitudinal direction B in two locations including an end position P1 (pre-position) located on the upstream side in the rotational direction A of the photoconductor drum 21 in the internal space of the shielding case 40 of the charging device 4, and an end position P2 (post-position) located on the downstream side in the rotational direction A. The pre-position P1 is a position that corresponds to substantially below the discharge wire 41A. Additionally, the post-position P2 is a position that corresponds to substantially below the discharge wire 41B.

As the blower duct 51, a blower duct is used in which the overall shape is that as shown in FIGS. 4 to 7 or the like, the inlet 52 has a substantially square opening shape with a dimension of 22 mm×23 mm, and the outlet 53 has an oblong opening shape with a dimension of 350 mm (dimension in the longitudinal direction B)×17.5 mm (dimension in the lateral direction C). Additionally, the upstream suppressing portion is configured by arranging a substantially flat-plate partition member 64 so that a gap 63 in which the height H is 1.5 mm in all regions along the longitudinal direction B of the outlet 53, the path length M is 8 mm, and the width W becomes 345 mm is present. Moreover, the outlet suppressing portion 62 is configured by arranging the ventilation holes 71 with a hole diameter of 1 mm and a length of 3 mm in a state where the outlet 53 is closed by the porous member 70 provided on the conditions that the density of the holes becomes 40.2 holes/$cm^2$.

Thus, in the charging device 4 in the image forming apparatus 1, as a measure for a case where the wind speed distribution of the air discharged from the outlet 53 of the blower duct 51 becomes non-uniform as mentioned above, the opening portion 43 in the shielding case 40 is constructed so that the permeability of the end region (E2: FIGS. 3A and 3B) that is present at least on one end side (here, the post-side) in the lateral direction C orthogonal to the longitudinal direction B in a region along the longitudinal direction B becomes a value smaller than the permeability of regions (E1: FIGS. 3A and 3B) other than the end region (E2).

In order to set the permeability of the end region at least on one end of the opening portion 43 in the charging device 4 to a value smaller than the permeability of regions other than the end region, in Exemplary Embodiment 1, the non-permeable member 45 is arranged as shown in FIGS. 3A and 3B, FIG. 5, or the like. The non-permeable member 45 has a physical property that does not show permeability and shows zero permeability. The non-permeable member 45 is arranged in an end region corresponding to the end region E2 (whole region or partial region) where the wind speed of the air discharged from the outlet 53 of the blower duct 51 is relatively faster as mentioned above, in the opening portion 43 of the shielding case 40. Here, as the non-permeable member 45, an elongated oblong plate member in which the dimension in the lateral direction C along the longitudinal direction B of the opening portion 43 becomes a required value K1 is provided at an end portion 43*a* located on the post-side of the opening portion 43.

Additionally, although the dimension (K1) in the lateral direction C of the non-permeable member 45 becomes a predetermined ratio with respect to the (total) dimension J of the opening portion 43 in the lateral direction C, for example, this dimension is set while checking, thorough tests, the degree of the effect of reducing a non-uniform state of wind speed when the air discharged from the outlet 53 of the blower duct 51 is taken in through the opening portion 43. It is desirable that the dimension (K1) of the non-permeable member 45 in the lateral direction C becomes a value of at least 20% or less with respect to the dimension J of the opening portion 43 in the lateral direction C, for example, from the viewpoint of reducing a wind-speed difference between the pre-side and post-side of the opening portion 43. Additionally, the thickness of the non-permeable member 45, for example, only needs to be equal to the thickness of a member that constitutes the shielding case 40. As such a non-permeable member 45, for example, a member that constitutes the shielding case 40, a material that has non-permeability, such as a resin material, or the like is used. In addition, although the non-permeable member 45 is installed in the state of being substantially parallel to the top plate 40*a* of the shielding case 40, the non-permeable member 45 may be arranged in an inclined state so that an end portion that faces the region of the opening portion 43 where the non-permeable member 45 is not set is present on the inner side of the case 40.

By installing the non-permeable member 45 in the charging device 4, the permeability of the end region (E2) that is present on the post-side of the opening portion 43 in the lateral direction C is set to a value (zero) that is smaller than the permeability of regions (E1) other than the end region (E2). In other words, the opening portion 43 in the charging device 4 is brought into a state where the end region (E2) that is present on the post-side of the opening portion in the lateral direction C is closed by the non-permeable member 45 with a permeability of zero.

Figure 10:
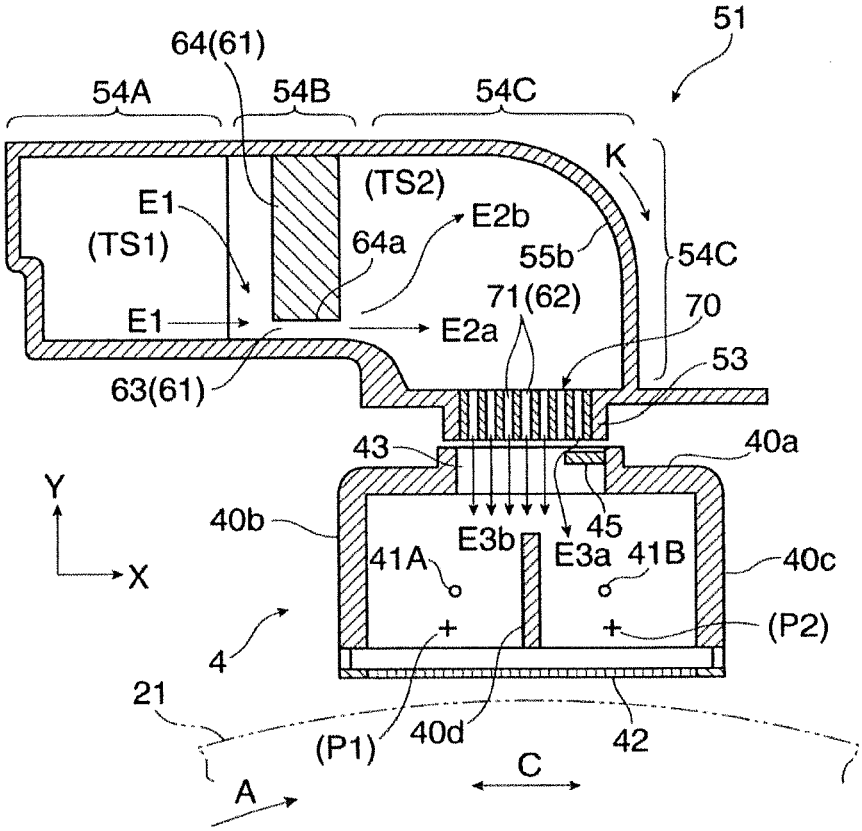
FIG. 10 is a cross-sectional explanatory view showing the operating state or the like of the charging device and the blowing device of FIG. 4.

In the charging device 4, as shown in FIG. 10, the course of the air (E3*a*) discharged in a state where the wind speed is relatively faster, from the end region (53*a*) that is present on the post-side that is one end side in the lateral direction C orthogonal to the longitudinal direction B in the region along the longitudinal direction B of the outlet 53 of the blower duct 51, is obstructed by the non-permeable member 45 that is arranged in the end region E2 on the post-side of the opening portion 43 in the shielding case 40.

In this case, the air (E3*a*) discharged in a state where the wind speed is relatively faster, as illustrated in FIG. 10, is brought into a state where the air strikes the non-permeable member 45 and the wind speed thereof is reduced, moves to the region (E1) of the opening portion 43 where the non-permeable member 45 is not present, and then flows into the case 40. On the other hand, the air (E3*b*) discharged in a state where the wind speed is relatively slower passes through the region (E1) of the opening portion 43 and flows into the case 40, without being obstructed in its course by the non-permeable member 45.

As a result, in the charging device 4, the air (E3) discharged from the outlet 53 of the blower duct 51 can be taken in from the opening portion 43 in a state where the difference in wind speed is reduced.

Figure 11:
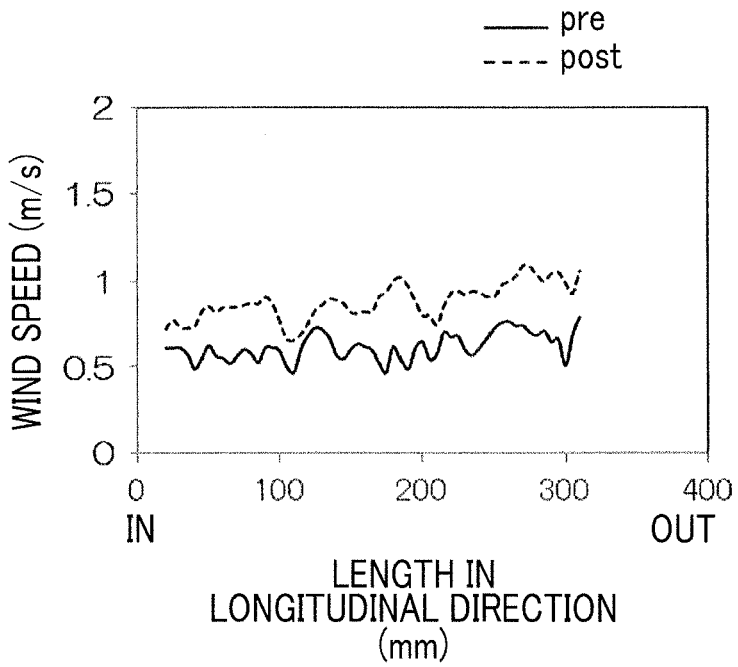
FIG. 11 is a graph chart showing the results when the ventilation distribution in the charging device of FIG. 9 is measured.

FIG. 11 shows the measurement results of the wind speed distribution in the charging device 4 in which the non-permeable member 45 is installed in the opening portion 43 to adjust permeability partially.

The contents of measurement are the same as those of the aforementioned measuring method. In this measurement, as the shielding case 40 of the charging device 4, there is used a shielding case in which the opening portion 43 including an oblong shape of which the dimension in the longitudinal direction B is 370 mm and the dimension J in the lateral direction is 16 mm is formed. As the non-permeable member 45, a non-permeable member in which the dimension K1 in the lateral direction C is 3 mm and the thickness is 1 mm is installed at the end portion on the post-side of the opening portion 43.

Figures 12A, 12B:
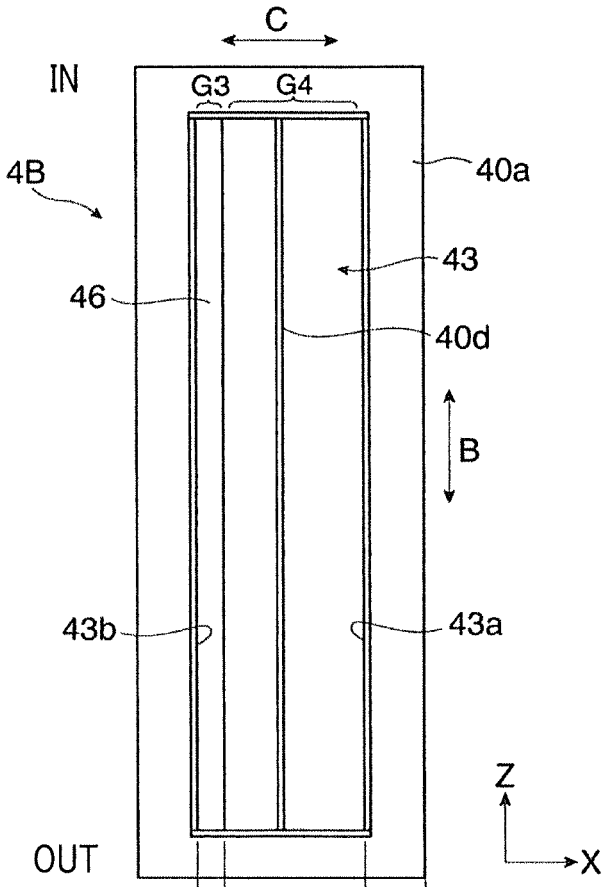
FIGS. 12A and 12B show a portion of the charging device related to Exemplary Embodiment 2.

From the results shown in FIG. 11, it turns out that the wind speed (dotted line) of air in the end region E2 of the charging device 4 on the post-side in the air (E3) taken in from the outlet 53 of the blower duct 51 through the opening portion 43 is reduced compared to the case (FIGS. 8 and 9) of the configuration where the non-permeable member 45 is not installed. Additionally, it turns out that the wind speed (solid line) of air in the end region of the charging device 4 (E3:

FIGS. 12A and 12B) on the pre-side is slightly increased compared to the case of the configuration in which the non-permeable member 45 is not installed. It can be inferred that this is caused by a phenomenon in where a portion of air in the end region E2 on the post-side of which the course is cut off by the non-permeable member 45 runs round and flows into the other region (E1). Accordingly, in the charging device 4, it turns out that the air (E3) discharged from the outlet 53 of the blower duct 51 is taken in a state where the difference in wind speed is reduced in the opening portion 43.

The air taken inside of the shielding case 40 through the opening portion 43 of the charging device 4 as mentioned above, as shown in FIG. 10 or the like, passes through the inside of two spaces that are divided using a partition wall 40*d* that is present at the center of the internal space of the case 40 as a boundary, and then is finally released the outside of the case 40 while passing through the gap between a shielding case 40 and the grid electrode 42 or a void in the grid electrode 42. At this time, since the air passing through the corona discharge wires 41A and 41B and the grid electrode 42 comes out from the outlet 53 at a substantially uniform wind speed in both the directions of the longitudinal direction B and the lateral direction C of the outlet 53 of the blower duct 51, the air is also blown against the two discharge wires 41A and 41B and grid electrode 42 in a substantially equal state.

Thereby, unnecessary substances, such as paper debris, an additive agent of toner, and a discharge product, which are going to adhere to the two discharge wires 41A and 41B and the grid electrode 42, respectively, in the charging device 4 can be kept away. As a result, degradation, such as unevenness, can be prevented from occurring in discharge performance (charge performance) owing to sparse adhesion of unnecessary substances to the discharge wires 41A and 41B or the grid electrode 42 in the charging device 4, and the peripheral surface of the photoconductor drum 21 can be more uniformly (uniformly in both directions of the axial direction and the circumferential direction along the rotational direction A) charged. Additionally, a toner image formed in the image forming unit 20 including the charging device 4, and an image finally formed on a sheet 9 are obtained as excellent images in which occurrence of image defects (uneven density or the like) resulting from charging defects, such as uneven charging, is reduced.

Exemplary Embodiment 2

FIGS. 12A and 12B show main portions of a charging device 4B related to Exemplary Embodiment 2. The charging device 4B has the same configuration as the charging device 4 related to Exemplary Embodiment 1 except that a change is made so that a non-permeable member is arranged at a different position of the opening portion 43. In the subsequent description and drawings, the constituent portions common to those of the charging device 4 related to Exemplary Embodiment 1 are designated by the same reference numerals, and the description thereof is omitted except when necessary (this is the same also in the subsequent embodiments).

That is, in the charging device 4B, as shown in FIGS. 12A and 12B, the non-permeable member 46 is installed at an end portion 43*b* located on the pre-side of the opening portion 43 of the shielding case 40, whereby the permeability of the end region (E3) that is present on the pre-side of the opening portion 43 in the lateral direction C is set to a value (zero) that is smaller than the permeability of regions (E4) other than the end region (E3).

Figure 13A:
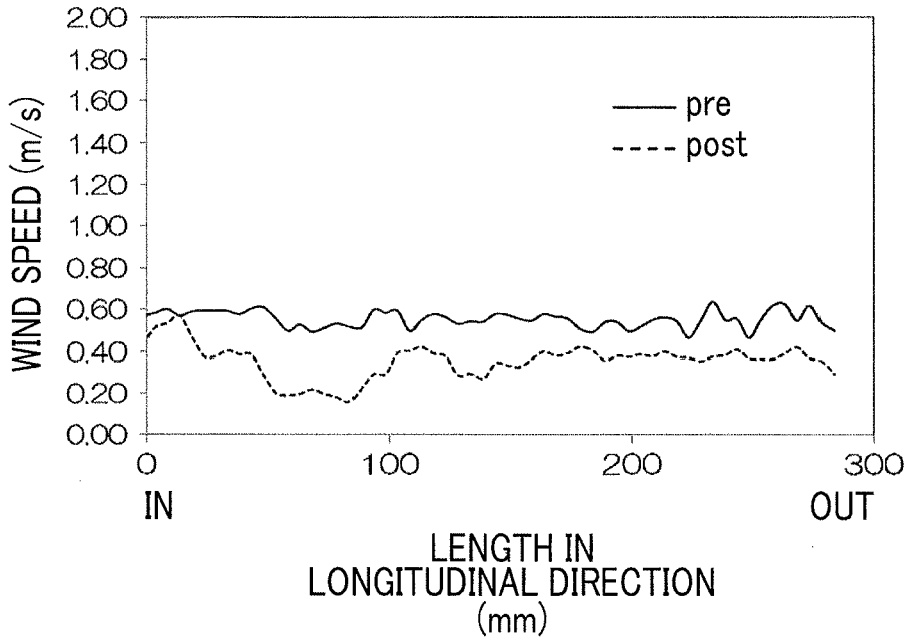
FIG. 13A is a graph chart showing the results when the ventilation distribution in a charging device of the related art is measured.

That is, as for the distribution of the wind speed of the air discharged from the blower duct 51 of the blowing device 5 to be applied to the charging device 4B, as illustrated in FIG. 13*a*, the wind speed (solid line) of the air discharged from an end region that is present on one end side (that is, an end portion 53*b* located on the pre-side) in the lateral direction C in the region along the longitudinal direction B of the outlet 53 of the blower duct 51 becomes relatively faster than the wind speed (dotted line) of the air discharged from regions other than the end region of the outlet. Thus, the charging device 4B is configured so as to match that distribution. Incidentally, the blower duct 51 having such wind speed distribution is configured so that the non-permeable member 46 closes a range of, for example, about 3 mm from the end portion located on the pre-side of the opening portion 43, for example, as compared to the blower duct 51 in Exemplary Embodiment 1.

As the non-permeable member 46, an elongated oblong plate member in which the dimension in the lateral direction C becomes a required value K2 along the longitudinal direction B of the opening portion 43 is provided at an end portion 43*b* located on the pre-side of the opening portion 43.

In the charging device 4B, the course of the air discharged in a state where the wind speed is relatively faster, from the end region (53*b*) that is present on the pre-side that is one end side in the lateral direction C in the region along the longitudinal direction B of the outlet 53 of the blower duct 51, is obstructed by the non-permeable member 46 that is arranged in the end region E3 on the pre-side of the opening portion 43 in the shielding case 40. As a result, in the charging device 4B, the air (E3) discharged from the outlet 53 of the blower duct 51 may be taken in from the opening portion 43 in a state where the difference in wind speed is reduced.

Figure 13B:
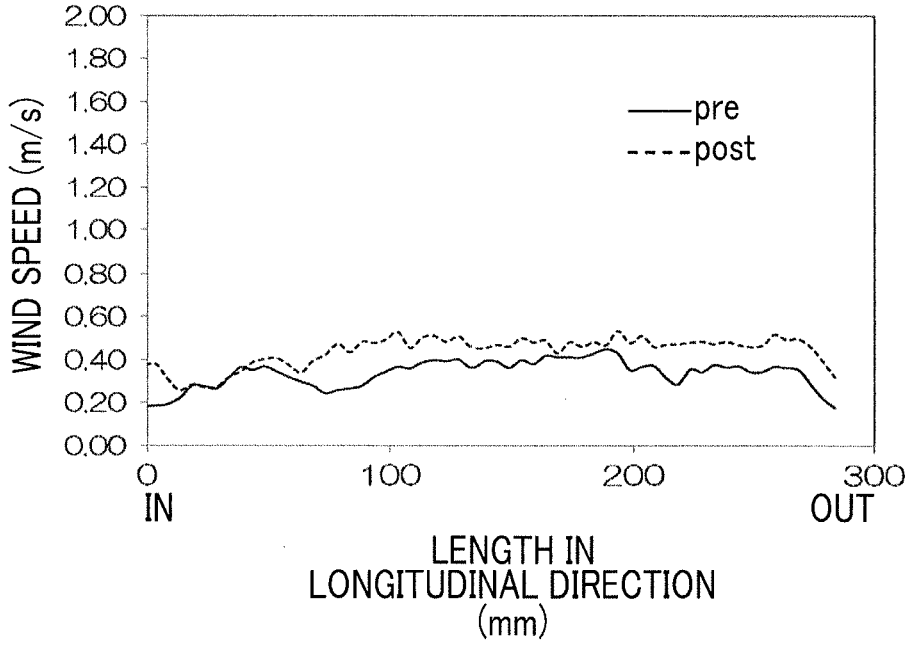
FIG. 13B is a graph chart showing the results when the ventilation distribution in the charging device of FIGS. 12A and 12B is measured.

FIG. 13B shows the measurement results of the wind speed distribution in the charging device 4B in which the non-permeable member 46 is installed in the opening portion 43 to partially adjust permeability. In this measurement, a non-permeable member in which the dimension K1 in the lateral direction C is 3 mm and the thickness is 1 mm is installed at the end portion on the pre-side of the opening portion 43. From the results shown in FIG. 13B, particularly, according to the charging device 4B, it turns out that the air discharged from the outlet 53 of the blower duct 51 is taken in a state where the difference in wind speed is further reduced in the opening portion 43.

Exemplary Embodiment 3

Figures 14A, 14B:
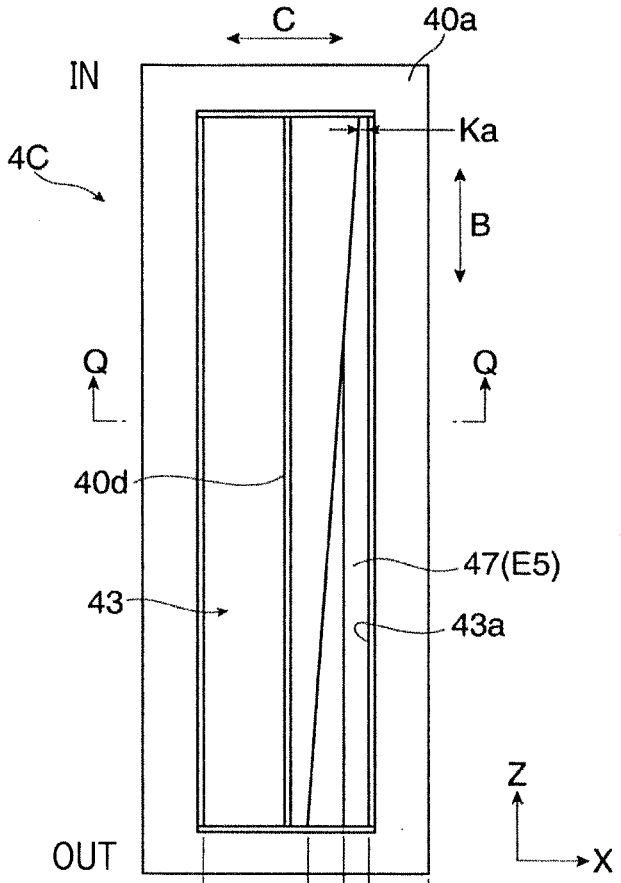
FIGS. 14A and 14B show a portion of the charging device related to Exemplary Embodiment 3.

FIGS. 14A and 14B show main portions of a charging device 4C related to Exemplary Embodiment 3. The charging device 4C has the same configuration as the charging device 4 related to Exemplary Embodiment 1 except that a change is made so that a non-permeable member having a shape in which the dimension in the lateral direction C varies in the longitudinal direction B is arranged as the non-permeable member.

That is, in the charging device 4C, as shown in FIGS. 14A and 14B, a planar (right-angled triangular) non-permeable member 47 in which the dimension K in the lateral direction C becomes gradually larger as shifting from the IN side (back side) of the image forming apparatus 1 to the OUT side (front side) thereof in the longitudinal direction B is installed at the end portion 43*a* located on the post-side of the opening portion 43 of the shielding case 40. Symbol Ka in FIGS. 14A and 14B represents the approximately minimum dimension in the lateral direction C on the IN side, and symbol Kb represents the maximum dimension in the lateral direction C on the OUT side. Thereby, the permeability of the end region (E5) that is present in an inclined state toward the post-side of the opening portion 43 in the lateral direction Cis set to a value (zero) that is smaller than the permeability of regions other than the end region.

That is, as for the distribution of the wind speed of the air discharged from the blower duct 51 of the blowing device 5 to be applied to the charging device 4C, as illustrated in FIG. 9, the wind speed (solid line) of the air discharged from an end region that is present on one end side (that is, the end portion 53*a* located on the post-side) in the lateral direction C in the region along the longitudinal direction B of the outlet 53 of the blower duct 51 becomes relatively faster than the wind speed (dotted line) of the air discharged from regions other than the end region of the outlet, and strictly, becomes gradually faster as the position shifts from the IN side of the image forming apparatus 1 to the OUT side thereof. Thus, the charging device 4C is configured so as to match that distribution more suitably.

In the charging device 4C, the course of the air discharged in a state where the wind speed is relatively faster, from the end region (53*a*) that is present on the post-side that is one end side in the lateral direction C in the region along the longitudinal direction B of the outlet 53 of the blower duct 51, is obstructed by the non-permeable member 47 that is arranged in the end region E2 on the post-side of the opening portion 43 in the shielding case 40. Moreover, in the charging device 4C, the air that is discharged while becoming gradually faster as the position shifts from the IN side of the image forming apparatus 1 to the OUT side thereof in the longitudinal direction B of the outlet 53 of the blower duct 51 is correspondingly obstructed so that courses are separately different by the non-permeable members 47 in a shape that the dimension K in the lateral direction C becomes gradually larger (inclined) from the IN side toward the OUT side. As a result, in the charging device 4C, the air (E3) discharged from the outlet 53 of the blower duct 51 may be taken in from the opening portion 43 in a state where the difference in wind speed is more suitably reduced.

Figure 15A:
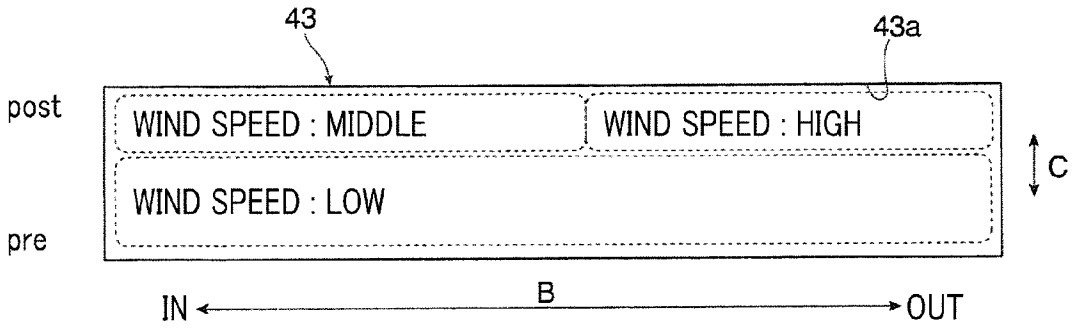
FIGS. 15A and 15B schematically show the configuration of a non-permeable member of the charging device related to Exemplary Embodiment 3.
Figure 15B:
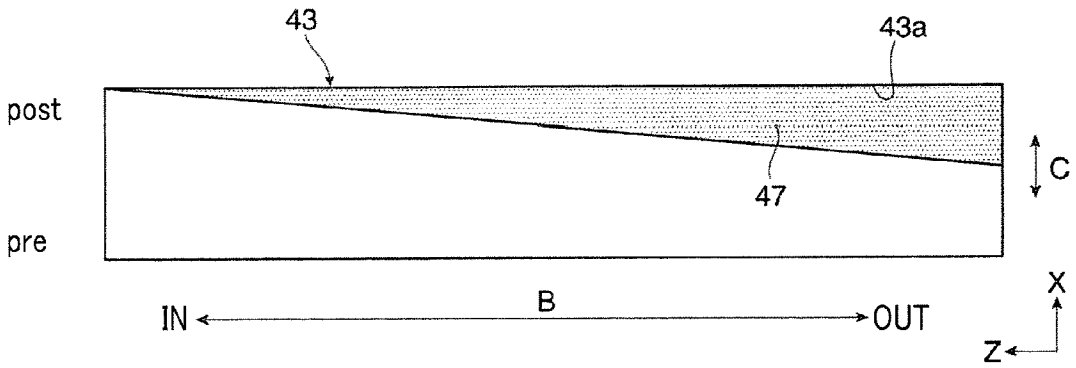

FIGS. 15A and 15B schematically show the relationship between the wind speed distribution of air when being discharged from the outlet 53 of the blower duct 51 and being taken in through the opening portion 43 of the charging device 4, and the shape (the dimension K in the lateral direction C) of the non-permeable member 47 matched with the wind speed distribution.

That is, as illustrated in FIG. 15A, the wind speed of the air taken in through the opening portion 43 has three levels of magnitude including "Low", "Middle", and "High". In a case where wind speed portions of "Middle" and "High" among them are present at the end portion on the post-side of the opening portion 43 and are dividedly present on the IN side and OUT side of the image forming apparatus 1, generally, the shape (the dimension K in the lateral direction C) of the non-permeable member 47 is configured as follows. That is, a shape portion in which the dimension K in the lateral direction C is relatively small is arranged as the non-permeable member 47 in the end region where a wind-speed portion of "Middle" of the opening portion 43 is present. Additionally, a shape portion in which the dimension K in the lateral direction C is relatively large may be arranged as the non-permeable member 47 in the end region where a wind-speed portion of "High" of the opening portion 43 is present. Incidentally, the wind speed portion of "High" corresponds to, for example, a portion or the like surrounded by a circle of a two-dot chain line among a data line shown by a dotted line on the post-side in the measurement results of the wind speed distribution illustrated in FIG. 9.

In this Exemplary Embodiment 3, as the non-permeable member 47, there is illustrated a non-permeable member of a shape (a shape that inclines linearly) in which the dimension Kin the lateral direction C increases in a definite proportion as the position shifts from the IN side of the image forming apparatus 1 to the OUT side thereof. However, the non-permeable member 47 is not limited to the shape that increases in such a proportion, and may be formed in a shape in which the dimension K in the lateral direction C is set (changed) to various values in the longitudinal direction B of the non-permeable member 47 in correspondence with the state of an actual wind speed distribution in the opening portion 43.

Exemplary Embodiment 4

Figure 16A:
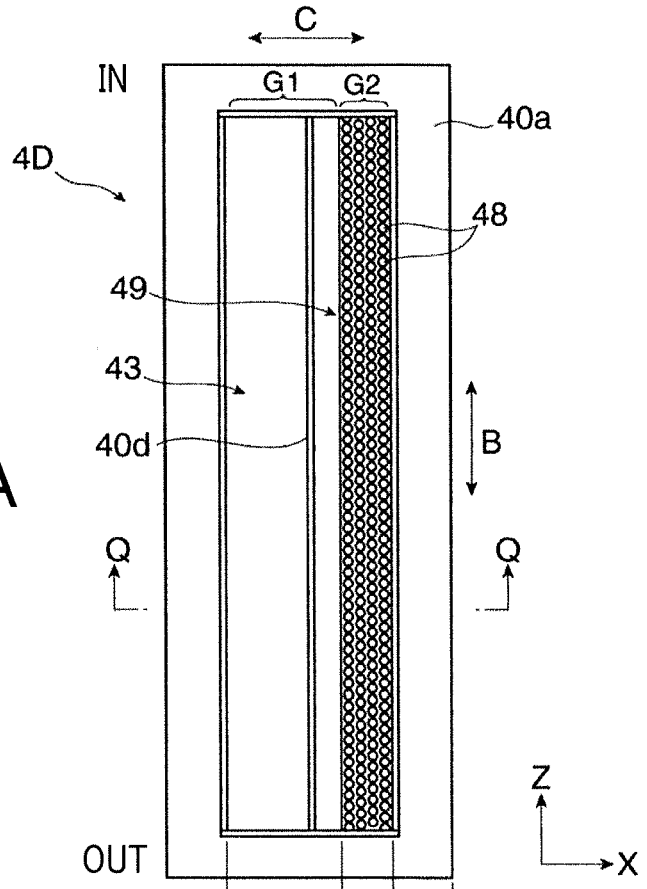
FIGS. 16A and 16B show a portion of the charging device related to Exemplary Embodiment 4.
Figure 16B:
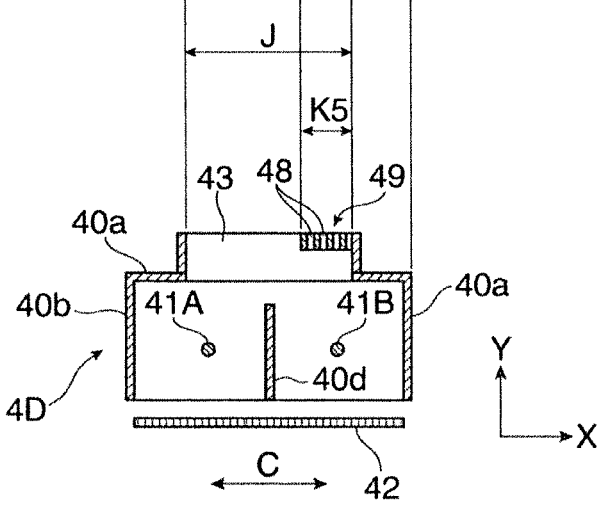

FIGS. 16A and 16B show main portions of a charging device 4D related to Exemplary Embodiment 4. The charging device 4D has the same configuration as the charging device 4 related to Exemplary Embodiment 1 except that a permeable member 49 having plural ventilation portions 48 is arranged instead of the non-permeable member 45.

That is, in the charging device 4D, as shown in FIGS. 16A and 16B, the permeable member 49 is installed at the end portion 43*a* located on the post-side of the opening portion 43 of the shielding case 40, whereby the permeability of the end region (E2) that is present on the post-side of the opening portion 43 in the lateral direction C is set to a value (zero) that is smaller than the permeability of regions (E1) other than the end region (E2).

Figure 17A:
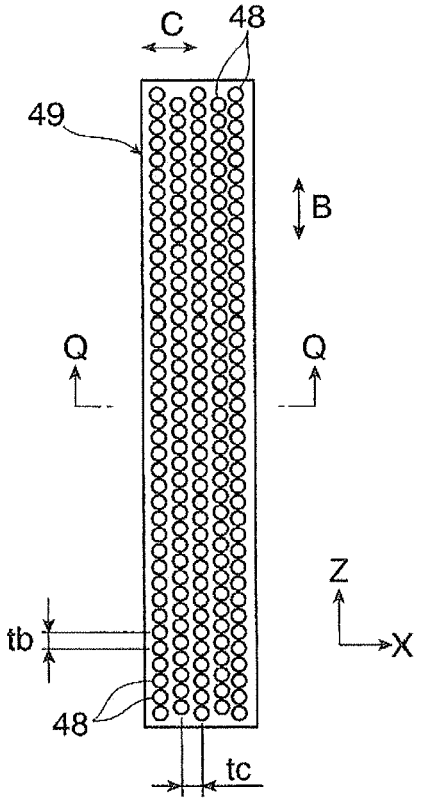
FIGS. 17A and 17B show a permeable member to be arranged in the charging device of FIGS. 16A and 16B.
Figure 17B:
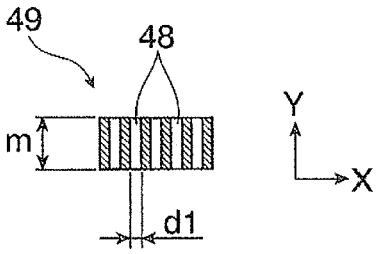

As shown in FIGS. 16A and 16B or FIG. 17, all the plural ventilation portions 48 in the permeable member 49 are through holes that extend so that each opening shape is substantially circular with almost the same hole diameter d1 and penetrate in the shape of a straight line. Additionally, the plural ventilation portions 48 are arranged side by side so as to be present, for example, in four rows, specifically, are arranged at regular intervals (tb) along the longitudinal direction (B) of the opening portion 43 of the shielding case 40, and are arranged at regular intervals (tc) even in the lateral direction C orthogonal to the longitudinal direction. The intervals (tb) in the longitudinal direction and the intervals (tc) in the lateral direction are set to the same value. Thereby, the plural ventilation portions (holes) 48 are formed so as to be dotted throughout the end region of which the permeability is set to a relatively small value in the opening portion 43. For this reason, the permeable member 49 in Exemplary Embodiment 4 is a perforated plate formed so that the plural ventilation portions (holes) 48 are dotted in a plate-shaped member. Additionally, although the thickness m of the permeable member 49 is not particularly limited, for example, the thickness is set to be approximately equal to the thickness of the constituent member of the shielding case 40. Moreover, it is preferable that the plural ventilation portions (holes) 48 be formed so as to be dotted almost uniformly (almost in constant density) in the end region of the opening portion 43 of which the permeability is set to a relatively small value. However, unless the air that passes through the opening portion 43 comes out non-uniformly, the ventilation portions may be formed so as to be present in a slightly dense state.

The permeable member 49 may be formed by being molded integrally with the shielding case 40 from the same material as the shielding case or may be formed from a material separate from the shielding case 40. The opening shape, opening dimensions, hole length, and hole presence density of the ventilation portions (holes) 48 are selected and set according to the setting contents of the permeability.

Incidentally, for example, in a case where the permeable member 49 is a perforated plate in which through holes are formed as the plural ventilation portions 48 as mentioned above, the permeability becomes the occupancy of the opening area (value when all the opening areas of the respective holes are totaled) of all the through holes to the total area of the surface of the perforated plate. That is, the permeability D in this case is expressed by the following equation "(Opening area of all through holes/Total area of plate member×100". Additionally, the permeability in a case where the permeable member 49 is a member other than this will be described below.

In the charging device 4D, the passage of the air discharged in a state where the wind speed is relatively faster, from the end region (53*a*) that is present on the post-side that is one end side in the lateral direction C in the region along the longitudinal direction B of the outlet 53 of the blower duct 51, is partially obstructed by the non-permeable member 49 that is arranged in the end region E2 on the post-side of the opening portion 43 in the shielding case 40, and this air passes only through the plural ventilation portions 48 in the permeable member 49. That is, only air equivalent to the permeability of the permeable member 49 passes through the ventilation portions. As a result, in the charging device 4D, the air (E3) discharged from the outlet 53 of the blower duct 51 may be taken in from the opening portion 43 in a state where the difference in wind speed is exactly reduced.

Modification of Exemplary Embodiment 4

Although a permeable member in which the plural ventilation portions (holes) 48 are uniformly arranged on the same conditions is illustrated as the permeable member 49 in Exemplary Embodiment 4, a permeable member in which the plural ventilation portions (holes) 48 are arranged on different conditions as shown below may also be applied.

Figure 18A:
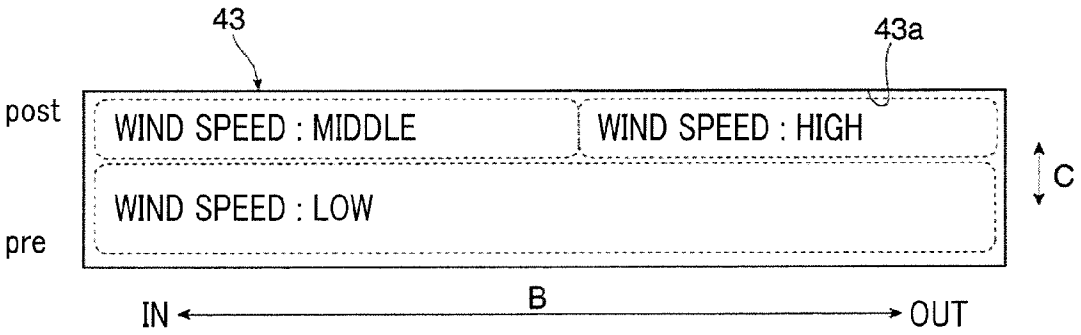
FIGS. 18A and 18B schematically show the configuration of a permeable member of the charging device related to Exemplary Embodiment 4.
Figure 18B:
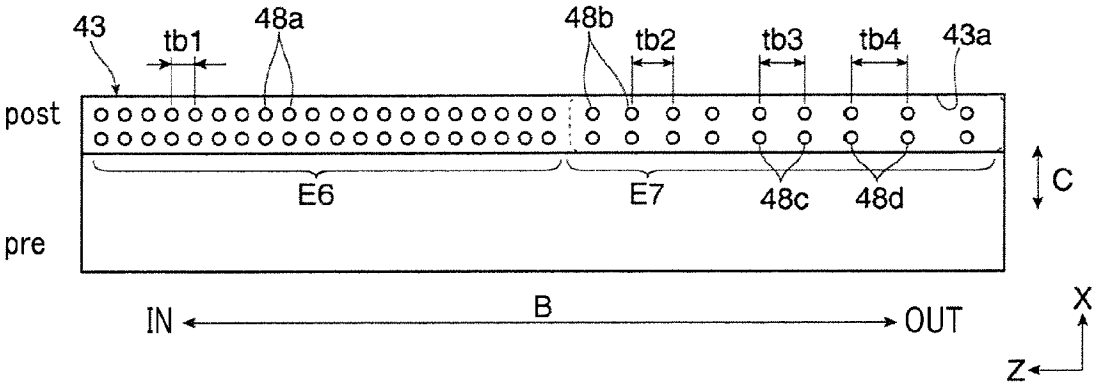

A configuration example of FIGS. 18A and 18B schematically show the relationship between the wind speed distribution of air when being discharged from the outlet 53 of the blower duct 51 and being taken in through the opening portion 43 of the charging device 4, and the arrangement contents of the ventilation portions 48 in the permeable member 49 matched with the wind speed distribution.

That is, as illustrated in FIG. 18A, the wind speed of the air taken in through the opening portion 43 has three levels of magnitude including "Low", "Middle", and "High". In a case where wind speed portions of "Middle" and "High" among them are present at the end portion on the post-side of the opening portion 43 and are dividedly present on the IN side and OUT side of the image forming apparatus 1, generally, the arrangement of the ventilation portions 48 of the permeable member 49 is configured as follows. That is, the plural ventilation portions (holes) 48 in the permeable member 49 are arranged at intervals where intervals tb1 in the longitudinal direction B have a relatively small value, in the end region where a wind-speed portion of "middle" of the opening portion 43 is present. That is, the plural ventilation portions (holes) 48 in the permeable member 49 are arranged at intervals tb2 or the like where intervals tb in the longitudinal direction B have a relatively larger value than the intervals tb1 of the ventilation portions (holes) 48 in the wind-speed portion of "middle", in the end region where a wind-speed portion of "High" of the opening portion 43 is present.

Additionally, for example, in a case where the wind speed changes so as to become gradually larger as shifting from the IN side to the OUT side in an end region where the wind speed portion of "high" of the opening portion 43 is present, the plural ventilation portions (holes) 48 in the permeable member may be arranged such that the intervals tb in the longitudinal direction B are set to respective intervals tb2, tb3 (>tb2), and tb4 (>tb3) that become gradually larger as shifting from the IN side to the OUT side. Moreover, in a case where the wind speed changes so as to become gradually larger as shifting from the pre-side to the post-side in the end region where the wind speed portion of "high" of the opening portion 43 is present, the plural ventilation portions (holes) 48 in the permeable member 49 may be arranged such that the intervals tc in the lateral direction C are set to respective intervals that become gradually larger as shifting from the pre-side to the post-side.

The permeable member 49 may also be configured using, for example, a porous member (configured with gaps that are formed as the plural ventilation portions 48 penetrate in an irregular shape), such as a nonwoven fabric to be applied to filters or the like. Incidentally, in a case where the above-described porous member is applied as the permeable member 49 is applied, the measurement of the permeability of the permeable member 49 may be performed, for example, according to the "Frazier Type Measuring Method of Evaluating Permeability of Fabric (Nonwoven Fabric Or The Like)" based on L1096 of Japanese Industrial Standard (JIS). Specifically, the permeability of the permeable member 49 may be indirectly obtained by measuring the permeability of the opening portion where the permeable member 49 is arranged and the permeability of the opening portion 43 where the permeable member 49 is not arranged, respectively, using the Frazier type air permeability tester or the like, and by obtaining a ratio (percentage) to the permeability in the case where the permeable member 49 is not arranged.

Other Exemplary Embodiments

In Exemplary Embodiments 1 to 4, the charging device 4 that is a blowing target structure, a charging device of a type in which the grid electrode 42 is not installed, a so-called corotron type charging device may be applied. Additionally, the charging device 4 may be a charging device using one corona discharge wire 41 or three or more corona discharge wires. The charging device 4 may include a cleaning device that cleans the corona discharge wires 41 or the grid electrode 42. In the case of the charging device 4 including this cleaning device, a suitable configuration for adjusting the permeability of the opening portion 43 is adopted in consideration of the positional relationship or the like between the opening portion 43 of the shielding case 40 and the component parts of the cleaning device.

Additionally, a blowing target structure that blows air from the blowing device 5 (blower duct 51) may be a corona discharger that performs neutralization of the photoconductor drum 21 or the like, or a corona discharger that charges or neutralizes charged members other than the photoconductor drum. In addition, an elongated structure that requires blowing of air other than the corona discharger may be used. Additionally, the blowing target structure may be a structure that is used in apparatuses other than the image forming apparatus and requires blowing of air.

Moreover, although a configuration example in which the two suppressing portions 61 and 62 are provided as plural suppressing portions is shown as the blower duct 51 of the blowing device 5, a blower duct in which three or more suppressing portions are provided may be applied. Additionally, it is preferable to provide suppressing portions other than the outlet suppressing portion 62 in a region whose cross-sectional shape is changed in the passage space TS of the passage portion 54 of the duct 51 or in a region after (immediately after or the like) the direction in which air is caused to flow in the passage space TS is changed. Additionally, the blower duct 51 is not limited to the case in which the overall shapes are those illustrated in Exemplary Embodiment 1 or the like, blower ducts having other shapes may be applied. For example, the blower ducts 510 (510A to 510D) illustrated in FIGS. 19A to 19D may also be applied. In addition, arbitrary blower ducts in which the wind speed of the air discharged from the outlet is relatively different may be applied.

Additionally, an image forming method or the like is not particularly limited if the image forming apparatus 1 includes the elongated target structure that needs to apply the blowing device 5 that has adopted the blower duct 51 or the like or the corona discharger 4 equipped with the blowing device 5. If necessary, the image forming apparatus may be an image forming apparatus that forms an image formed from materials other than developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blowing target structure comprising:

an opening portion that:

(a) is an inlet into which an air flow from a blower pipe, where the inlet has an elongated shape in one direction, (b) is elongated in the one direction, which is the same direction as an outlet of the blower pipe that is also elongated, and (c) comprises a member that is provided at least on one end side of the opening portion in a lateral direction orthogonal to a longitudinal direction of the opening portion so that the member is configured to set an air permeability of a member side region of the opening portion to a value smaller than an air permeability of a region other than the member side region of the opening portion.

2. The blowing target structure according to claim 1, wherein the member is a non-permeable member that does not allow air to permeate therethrough.

3. The blowing target structure according to claim 1, wherein the member is a permeable member having a plurality of ventilation portions.

4. The blowing target structure according to claim 1, wherein a size in the lateral direction of the member varies in the longitudinal direction.

5. The blowing target structure according to claim 2, wherein a size in the lateral direction of the member varies in the longitudinal direction.

6. The blowing target structure according to claim 3, wherein a size in the lateral direction of the member varies in the longitudinal direction.

7. The blowing target structure according to claim 1, wherein the air permeability of the member side of the opening portion varies in one or both of the longitudinal direction and the lateral direction.

8. The blowing target structure according to claim 3, wherein the air permeability of the member side of the opening portion varies in one or both of the longitudinal direction and the lateral direction.

9. The blowing target structure according to claim 4, wherein the air permeability of the member side of the opening portion varies in one or both of the longitudinal direction and the lateral direction.

10. The blowing target structure according to claim 5, wherein the air permeability of the member side of the opening portion varies in one or both of the longitudinal direction and the lateral direction.

11. The blowing target structure according to claim 6, wherein the air permeability of the member side of the opening portion varies in one or both of the longitudinal direction and the lateral direction.

12. The blowing target structure according to claim 1, wherein the member is located at a position to face a region where the wind of the air flows relatively fast at the outlet of the blower pipe.

13. The blowing target structure according to claim 1, wherein the blower pipe is provided with:

an inlet that takes in air;

an outlet that is arranged in the state of facing an opening portion that (a) is an inlet into which the air flow from a blower pipe that has an elongated shape in one direction, (b) is elongated in the same direction as the one direction of an outlet of the blower pipe, (c) has a member that is provided at least on one end side in a lateral direction orthogonal to a longitudinal direction of the opening portion to set an air permeability of a member side region of the opening portion to a value smaller than an air permeability of a region other than the member side region of the opening portion so as to discharge the air taken in from the inlet, and has a shape different from the inlet;

a flow path having a portion that connects the inlet and the outlet to cause air to flow therethrough and that has a flow direction bent substantially at a right angle; and a plurality of flow control members that are provided in mutually different regions in the direction in which the air in a passage space of the flow path is caused to flow, and that control the flow of the air.

14. The blowing target structure according to claim 1, wherein the blowing target structure is a corona discharger including a surrounding member formed with the opening portion, and a discharge wire stretched in an internal space of the surrounding member.

15. An image forming apparatus comprising:

a blower pipe provided with an outlet that is elongated in one direction; and the blowing target structure according to claim 1.

16. The image forming apparatus according to claim 15, wherein the blowing target structure is a corona discharger including a surrounding member formed with the opening portion, and a discharge wire stretched in an internal space of the surrounding member.

17. The blowing target structure according to claim 4, wherein the opening portion is trapezoidal shape formed by the opening portion.

18. The blowing target structure according to claim 3, wherein each of the ventilation portions forms a hole on the opening portion, and a density of an arrangement of the ventilation portions varies in the longitudinal direction.

* * * * *